US006536116B2

(12) United States Patent
Fung

(10) Patent No.: US 6,536,116 B2
(45) Date of Patent: Mar. 25, 2003

(54) HAIR CLIPPER WITH ROTATING BLADE ASSEMBLY

(75) Inventor: Kam Fai Fung, Hong Hong (HK)

(73) Assignee: Conair CIP, Inc., Stamford, CT (US)

( * ) Notice: Subject to any disclaimer, the term of this patent is extended or adjusted under 35 U.S.C. 154(b) by 0 days.

(21) Appl. No.: 10/021,733

(22) Filed: Oct. 22, 2001

(65) Prior Publication Data

US 2002/0092178 A1 Jul. 18, 2002

Related U.S. Application Data

(60) Provisional application No. 60/261,401, filed on Jan. 12, 2001.

(51) Int. Cl.[7] ..... B26B 15/00
(52) U.S. Cl. ..... 30/199
(58) Field of Search ..... 30/177, 199, 321

(56) References Cited

U.S. PATENT DOCUMENTS

| | | | | |
|---|---|---|---|---|
| 335,956 A | | 2/1886 | Phipps et al. | |
| 382,288 A | | 5/1888 | Lee | |
| 458,940 A | | 9/1891 | Bonham | |
| 532,188 A | * | 1/1895 | Shannon | 30/199 |
| 558,973 A | | 4/1896 | Milliken | |
| 755,169 A | | 3/1904 | Priest | |
| 1,343,175 A | | 6/1920 | Lafontaine | |
| 1,602,252 A | * | 10/1926 | Ritzmann | 30/199 |
| 1,673,643 A | | 6/1928 | Sekulich | |
| 2,484,610 A | | 10/1949 | Cromonic | 30/223 |
| 3,991,464 A | | 11/1976 | Ihasz | 30/34.1 |
| 4,074,427 A | | 2/1978 | Marchetti et al. | 30/34.1 |
| 5,579,581 A | | 12/1996 | Melton | 30/223 |
| 5,606,799 A | | 3/1997 | Melton | 30/216 |
| 5,970,616 A | | 10/1999 | Wahl et al. | 30/216 |
| D432,265 S | | 10/2000 | Kling et al. | D28/53 |

FOREIGN PATENT DOCUMENTS

| | | |
|---|---|---|
| DE | 198 59 017 C1 | 2/2000 |
| WO | WO 00/37225 | 6/2000 |
| WO | WO 00/37226 | 6/2000 |

* cited by examiner

*Primary Examiner*—Douglas D. Watts
(74) *Attorney, Agent, or Firm*—Ohlandt, Greeley, Ruggiero & Perle LLP

(57) ABSTRACT

There is provided a hair clipper with a housing having a control for selectively connecting a motor positioned in the housing to an energy source. The hair clipper also having a rotating blade assembly with one or more cutting edges and a switch mechanism operatively connected to said blade assembly. The hair clipper allows the blade assembly to be efficiently and effectively adjusted to conveniently provide a user with several different hair cutting options.

32 Claims, 4 Drawing Sheets

HAIR CLIPPER WITH ROTATING BLADE ASSEMBLY

This application claims the benefit of Provisional application Ser. No. 60/261,401, filed Jan. 12, 2001.

BACKGROUND OF THE INVENTION

1. Field of the Invention

The present invention relates to hair clippers or trimmers. More particularly, the present invention relates to a hair clipper having a rotating clipper blade assembly. The clipper blade assembly of the present invention rotates about an axis substantially normal to the cutting plane defined by the blade assembly.

2. Description of the Prior Art

Electric hair clippers having a clipper blade assembly including a stationary blade and a reciprocating blade are known in the art. The stationary blade and the reciprocating blade each have a plurality of teeth along the leading edge of the blades. The clipper blade assembly is mounted to the clipper handle such that the teeth of the stationary blade are substantially parallel to the teeth of the reciprocating blade. In this manner, reciprocating the reciprocating blade with respect to the stationary blade trims hair positioned between the teeth.

The width of the blade assembly dictates the area on one's body from which hair can be effectively removed. For instance, wide blade assemblies are useful for removing hair from large areas, such as the face, head, legs or back. However, wide blade assemblies prove to be too cumbersome and un-useable in areas such as the nose, ears, and the like. In these locations, narrow blade assemblies prove much more useful.

Currently, a user either needs multiple devices, namely a device with a narrow blade assembly and a second device with a wide blade assembly, or a single device with interchangeable blade assemblies. Neither solution is desirable to the consumer. Multiple devices are duplicative and expensive. A single device with interchangeable blade assemblies has too many parts that can be easily lost. Thus, it is desirable to provide a hair clipper that permits adjustment of the blade assembly so as to provide both wide and narrow blade assemblies to the user in a single, simple device.

U.S. Pat. No. 5,579,581 assigned on its face to Wahl Clipper Corporation is directed to a clipper blade having multiple cutting edges, namely a cutting edge at each end of the blade. However, the cutting edges on each end are substantially identical such that each blade can be used as either of the fixed blade or the moving blade. Thus, the use of wide and narrow blades in the same blade assembly is not provided.

U.S. Pat. No. 5,606,799 also assigned on its face to Wahl Clipper Corporation is directed to a hair clipper having a balland-socket connection being provided between the handle and the blade assembly. The ball-and-socket configuration allows the blade assembly to be pivoted with respect to the handle. However, the ability to rotate the blade assembly about an axis substantially normal to the cutting plane defined by the blade assembly is not provided. Moreover, the use of wide and narrow blades in the same blade assembly is not provided.

U.S. Pat. No. 5,970,616 is also assigned on its face to Wahl Clipper Corporation. This patent is directed to a hair trimmer that includes a blade housing that is rotatable about an axis substantially parallel to the axis of the handle to vary the angular orientation of the blade housing with respect to the handle. However, the ability to rotate the blade assembly about an axis substantially normal to the cutting plane defined by the blade assembly is not provided. Moreover, the use of wide and narrow blades in the same blade assembly is not provided.

German Patent DE 198 59 017 C1 assigned on its face to Braun GbmH is directed to a hair trimmer that provides both wide and narrow blades to the user in a single device. Specifically, the cutting head is swiveled around a swivel axis that is substantially parallel to the blade assembly. The cutting head also includes two different cutting and separate cutting blades. Moreover, only one of the cutting blades is operable at a time. Thus, a clipper with a blade assembly that rotates about an axis substantially normal to the cutting plane defined by the blade assembly so as to present to the user one of several different cutting edges is not provided. Moreover, such a simple rotatable clipper having a single cutting blade is not provided.

Accordingly, there is a continuing need for simple hair clippers that present both wide and narrow blade assemblies to the user. Moreover, there is a continuing need for such a hair clipper that rotates the blade assembly about an axis substantially normal to the cutting plane defined by the blade assembly.

SUMMARY OF THE INVENTION

It is an object of the present invention to provide a clipper that presents both wide and narrow blade assemblies to the user.

It is another object of the present invention to provide a simple hair clipper having a rotatable blade assembly in which the assembly is rotatable about an axis substantially normal to the cutting plane defined by the blade assembly.

It is another object of the present invention to provide a clipper with a blade assembly that rotates about an axis substantially normal to the cutting plane defined by the blade assembly so as to present to the user one of several different cutting edges.

It is a further object of the present invention to provide a rotatable clipper having a single cutting blade.

DETAIL DESCRIPTION OF THE INVENTION

Figure 1:
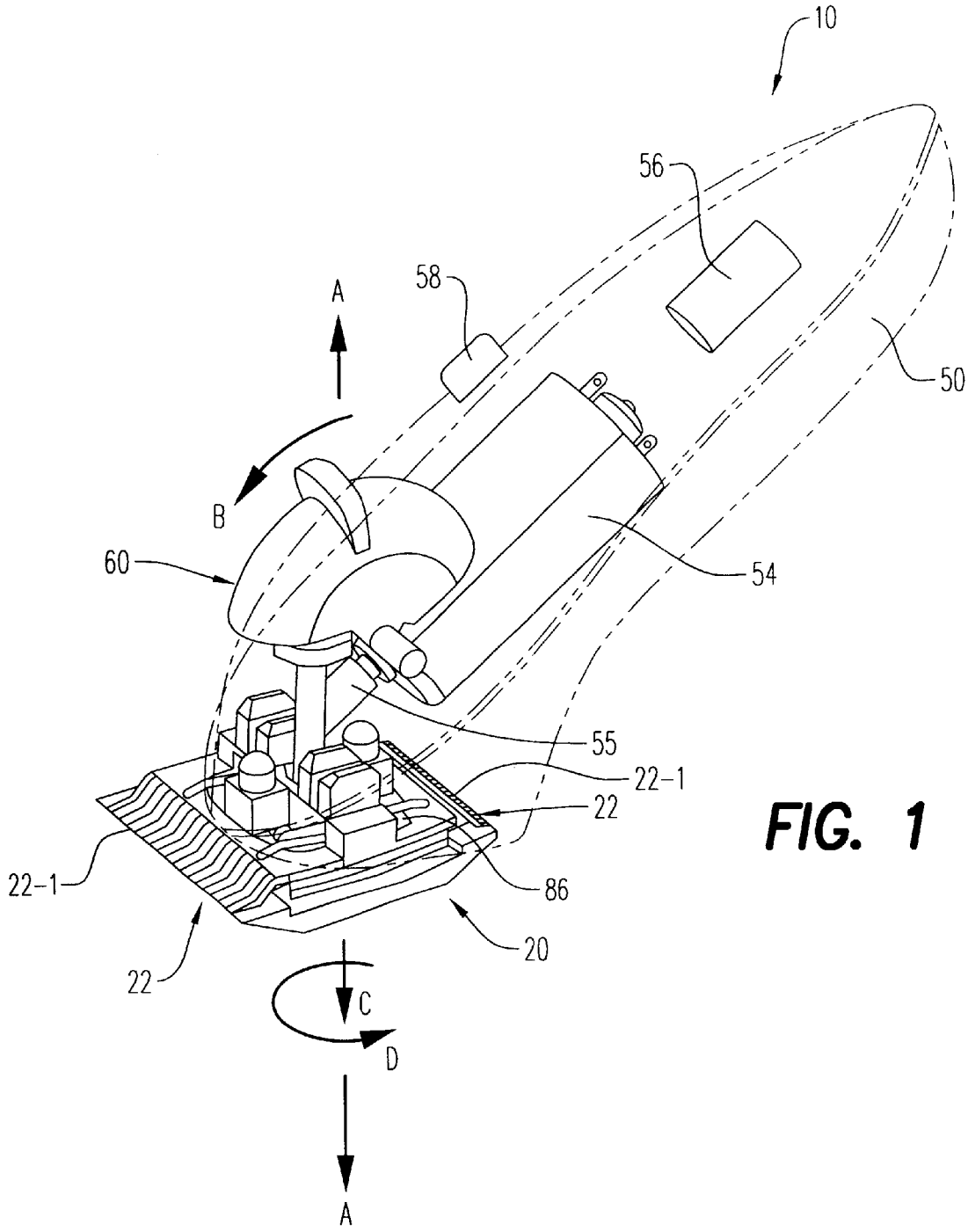
FIG. 1 is a perspective view of a first embodiment of the clipper of the present invention.

Referring to the figures and particularly to FIG. 1, a clipper, generally represented by reference numeral 10, is shown. Clipper 10 includes a blade assembly 20 and a housing 50. Clipper 10 is adapted to rotate blade assembly 20 about an axis, designated axis A. Axis A is substantially normal or perpendicular (hereinafter normal) to the cutting plane defined by blade assembly 50. Blade assembly 20 includes more than one cutting edge 22 that define the cutting plane of the blade assembly. Thus, clipper 10 is adapted to present more than one cutting edge 22 to the user.

In the embodiment of FIG. 1, blade assembly 20 has a wide cutting edge 22-1 and a narrow cutting edge 22-2. Thus, clipper 10 is adapted to present the user with the ability to convert the clipper from one with a wide cutting edge 22-1 for certain uses to one with a narrow cutting edge 22-2 for other uses.

It should be understood that the present invention is described by way of example. Thus, it should be recognized that three or more cutting edges 22 are considered within the scope of the present invention. Moreover, it should be recognized that presenting more than one cutting edge 22 having the same width, tooth shape and the like is also considered within the scope of the present invention.

Housing 50 has a blade switching mechanism 60, a motor 54 adapted to be positioned in the housing, an energy source 56 for energizing the motor, and a control 58.

Motor 54 is operatively connected to blade assembly 20 via an offset shaft 55 such that the motor, when energized, drives the blade assembly via the shaft. Motor 54 is also connected to energy source 56, such as a battery or a plug coupled with a standard residential electrical outlet, and control 58. The user, by control 58, can selectively connect and disconnect motor 54 and energy source 56 to energize and de-energize, respectively, the motor. Control 58 can be for example, a switch.

Figure 2:
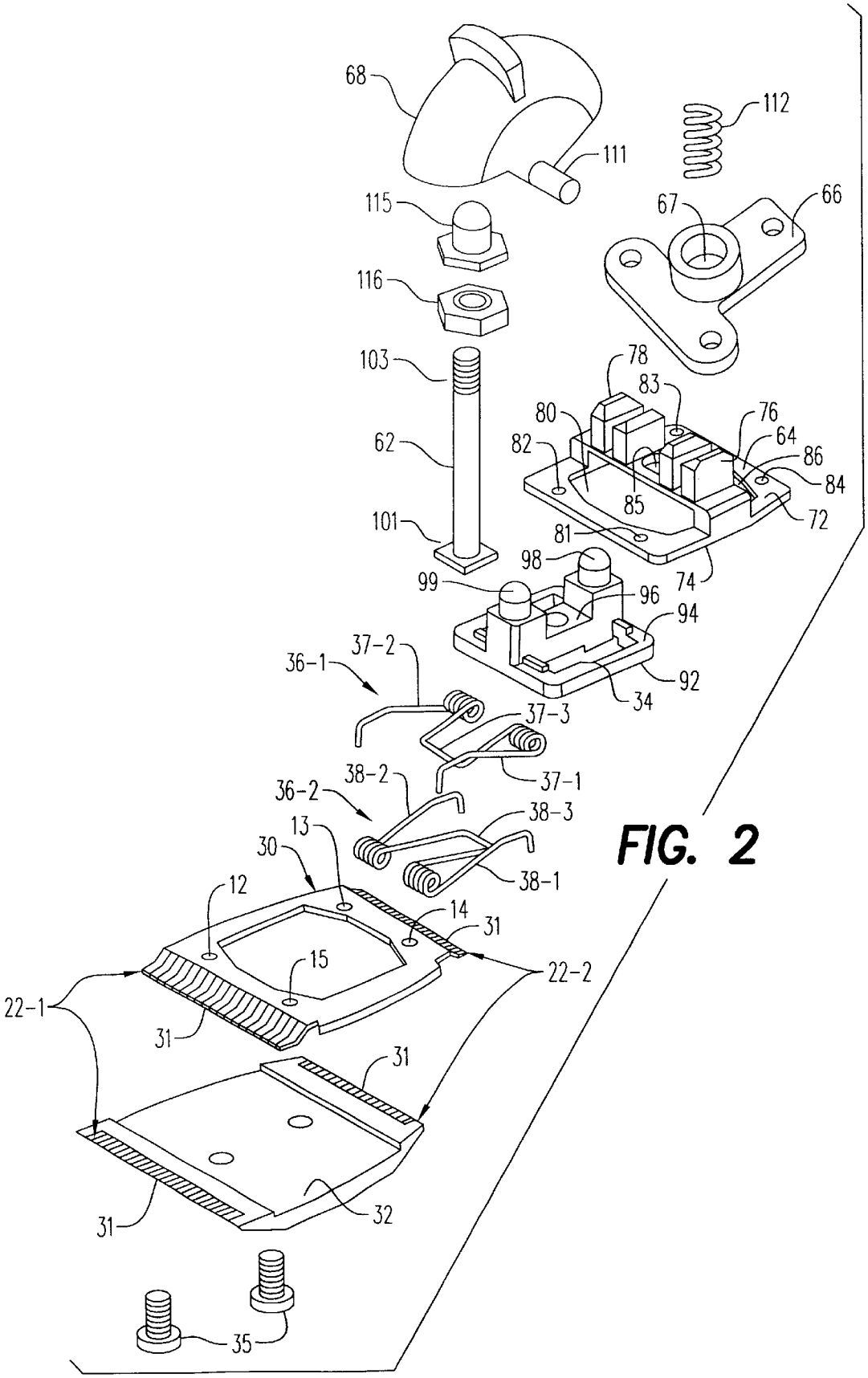
FIG. 2 is an exploded view of the clipper of FIG. 1.

As shown in FIG. 2, blade assembly 20 has a cutting or reciprocating blade 30, a stationary blade 32 adapted to be positioned adjacent the reciprocating blade, a mounting block 34, one or more screws 35, a first spring 36-1 and a second spring 36-2. Reciprocating blade 32 has a series of spring holes 11, 12, 13 and 14. Mounting block 34 has a topside 92, a bottom side 94, a mounting post recess 96, a first locking member 98 and a second locking member 99.

Stationary blade 30 and reciprocating blade 32 are mounted to a mounting block 34 by screws 35 and springs 36-1, 36-2 in a conventional manner. More specifically, reciprocating blade 30 and stationary blade 32 each have a series of cutting teeth 31 that are substantially parallel to one another to form wide cutting edge 22-1 and narrow cutting edge 22-2. Springs 36-1, 36-2 bias reciprocating blade 32 towards stationary blade 30 and aid to reciprocate reciprocating blade 32 as described below. Spring 36-1 has a set of biasing arms 37-1 and 37-2 and a central member 37-3. Similarly, spring 36-2 has a set of biasing arms 38-1 and 38-2 and a central member 38-3.

Blade assembly 20 is operatively connected to blade switch mechanism 60 to rotate the blade assembly. Blade switch mechanism 60 has a mounting post 62, a slider block 64, a bracket 66, and a button 68.

Slider block 64 has a top side 72, a bottom side 74, a first driven connection 76, a second driven connection 78, a first locking member opening 80, a second locking member opening 86, spring holes 81, 82, 83 and 84, and a central mounting post opening 85.

Spring holes 81, 82, 83 and 84 of slider block 64 correspond to a matching set of spring holes 11, 12, 13 and 14 in reciprocating blade 32.

Bottom side 74 of slider block 64 is inserted over top side 94 of mounting block 34 such that first locking member 98 is in first locking member opening 80, and second locking member 99 is in second locking member opening 86. In this position, shaft 55 of motor is operatively connected to second driven connection 78 of slider block 64 to impart reciprocating motion to the slider block.

Central member 37-3 of first spring 36-1 rests on stationary blade 30. Arms 37-1 and 37-2 rest on topside 72 of slider block 64. Thus, first arm 37-1 is inserted through spring hole 81 of slider block 64 and spring hole 11 of reciprocating blade 30, and second arm 37-2 is inserted through spring hole 82 of the slider block and spring hole 12 of the reciprocating blade. Second spring 36-2 is similarly situated. Namely, central member 38-3 of second spring 36-2 rests on stationary blade 30. Arms 38-1 and 38-2 rest on topside 72 of slider block 64. Thus, first arm 38-1 is inserted through spring hole 84 of slider block 64 and spring hole 14 of reciprocating blade 30 and second arm 37-2 is inserted through spring hole 83 of the slider block and spring hole 13 of the reciprocating blade. In this manner, reciprocation of slider block 64 back and forth is transmitted via springs 36-1, 36-2 to reciprocating blade 30 as the reciprocating blade is biased towards stationary blade 32.

It should be noted that slider block 64 and mounting block 34 are not secured to one another. Rather, springs 36-1, 36-2 merely compress bottom 74 of slider block 64 onto top 94 of mounting block 34. By overcoming the compressive forces of springs 36-1, 36-2, mounting block 34 is slidable downward as described in detail below such that first locking member 98 is no longer in first locking member opening 80 and second locking member 99 is no longer in second locking member opening 86. It should also be noted that shaft 55 of motor 54 is not secured to second driven connection 78 of slider block 64. Rather, shaft 55 and second driven connection 78 are only connected to enable motor 54 to impart reciprocating motion to slider block 64. Sliding mounting block 34 downward with respect to slider block 64 as described in detail below causes shaft 55 to be removed from second driven connection 78.

Mounting post 62 has a biasing end 101 and a control end 103. Biasing end 101 is inserted through mounting post-opening 85 of slider block 64 into mounting post recess 96 of mounting block 34. Post 62 extends upward from blade assembly 20 into housing 50. Bracket 66 is secured in position in housing 50 such that post 62 is slidably received in a bore 67 defined therein. Post 62 is of sufficient length such that control end 103 extends out of housing 50.

Button 68 is connected to control end 103 of mounting post 62, preferably via a cam 115 and a bolt 116. Button 68 is rockably mounted in housing 50 via a pair or rocker arms 111 disposed on either side of the button. When rocking button 68 is rocked towards the front of housing 50, i.e. towards blade assembly 20, in the direction of arrow B, the button exerts a downward force C onto mounting post 62 in direction parallel to axis A. Button 68 is biased in its normal position in which the button is not exerting force C onto mounting post 62. Preferably, button 68 is biased in its normal position by a spring 112 disposed between bracket 66 and housing 50. Spring 112 exerts a button return force, opposite to force C, to button 68 to rock the button away from the front of housing 50 (i.e. away from blade assembly 20).

Force C being sufficient to overcome the return force of spring 112 and the compressive forces of springs 36-1, 36-2, causes mounting post 62 to slide downward in bracket 66 and slider block 64 such that biasing end 101 of the post urges mounting block 34 downward. Mounting block 34 slides downward such that first locking member 98 is no longer in first locking member opening 80, second locking member 99 is no longer in second locking member opening 86, and shaft 55 is no longer operatively connected to second driven connection 78. At this point, application of a rotational force D on blade assembly 20 causes the blade assembly to rotate about axis A with respect to housing 50. More specifically, mounting block 34 rotates with respect to slider block 64 until first locking member 98 is adapted to be inserted in second locking member opening 86, second locking member 99 is adapted to be inserted in first locking member opening 80, and shaft 55 is adapted to be operatively connected to first driven connection 76.

Removal of force B from button 68 causes spring 112 to exert button return force to rock the button away from the front of housing 50 to remove downward force C from mounting post 62 and causes springs 36-1, 36-2 to bias mounting block 34 up towards slider block 64. Thus, post 62 slides upwards through bracket 66 and slider block 64 until first locking member 98 is in second locking member opening 86, second locking member 99 is in first locking member opening 80, and shaft 55 is operatively connected to first driven connection 76.

Thus, switch mechanism 60 allows the user to rotate blade assembly 20 to present either wide cutting edge 22-1 or narrow cutting edge 22-2 to the user.

Figure 3:
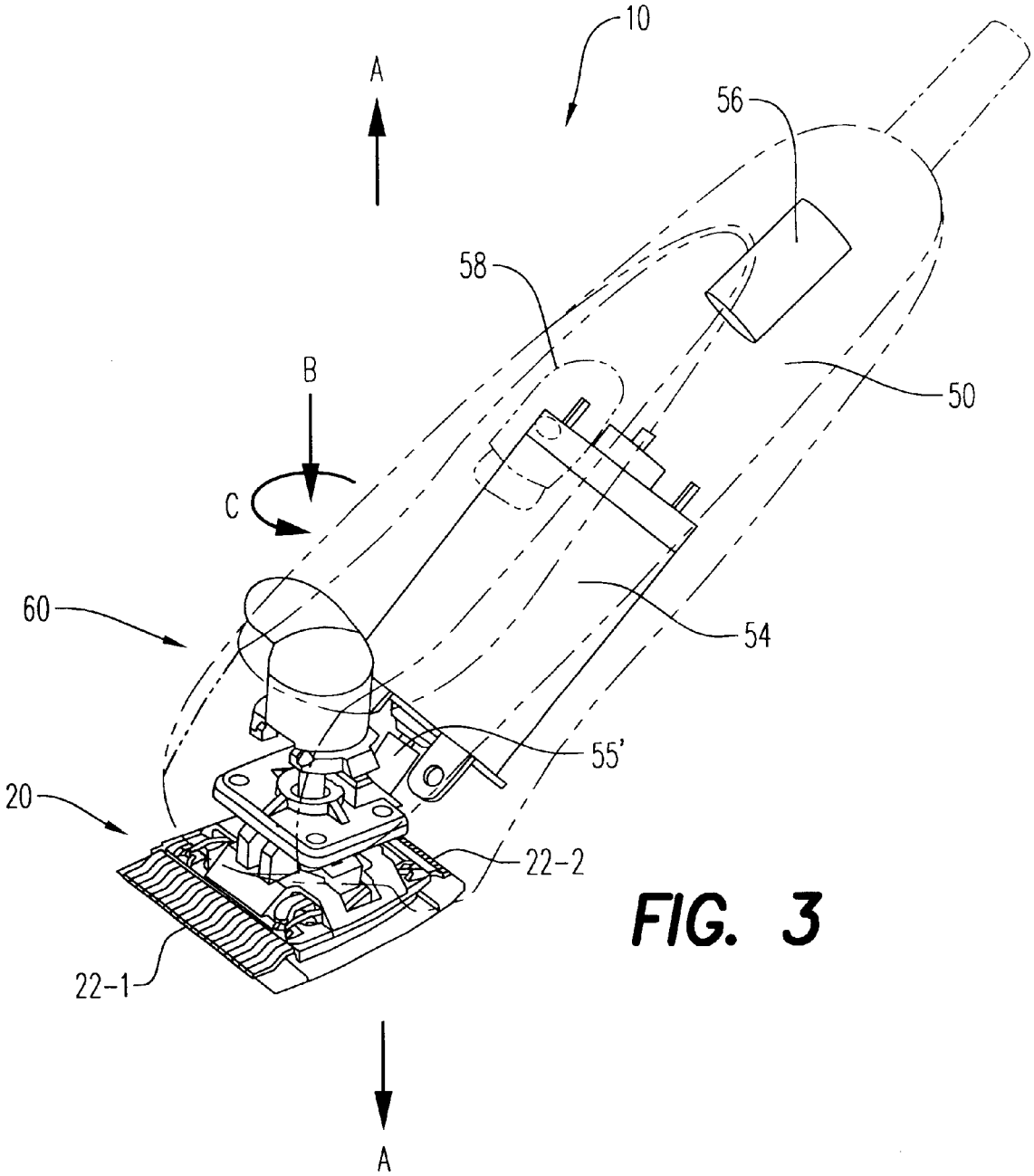
FIG. 3 is a perspective view of a second embodiment of the clipper of the present invention.
Figure 4:
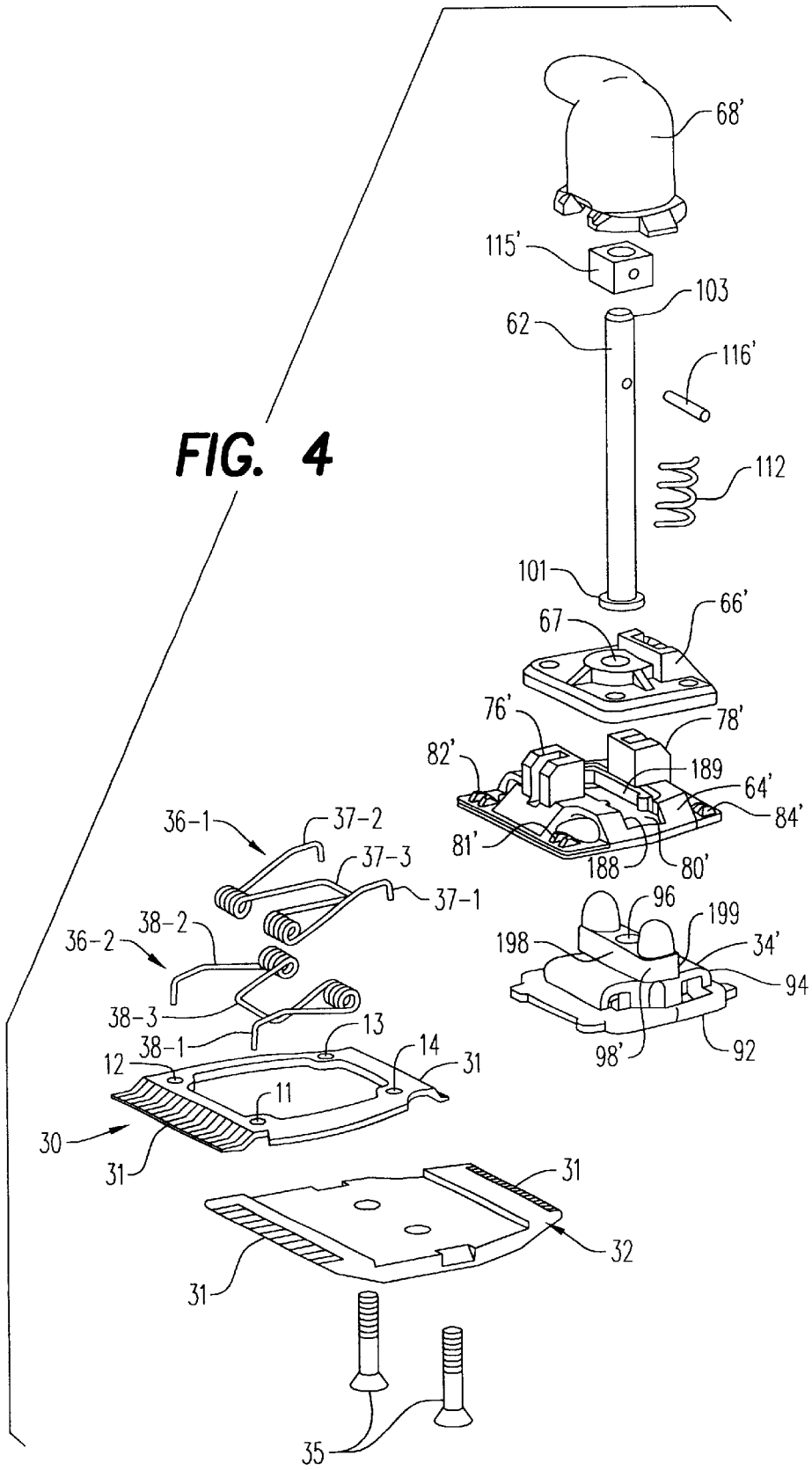
FIG. 4 is an exploded view of the clipper of FIG. 3.

An alternate embodiment of switch mechanism 60 is shown in FIGS. 3 and 4. Like reference numerals are used to designate elements previously provided.

In the embodiment of FIG. 3, blade assembly 20 also has a wide cutting edge 22-1 and a narrow cutting edge 22-2. Thus, clipper 10 is adapted to present the user with the ability to convert the clipper from one with a wide cutting edge 22-1 for certain uses to one with a narrow cutting edge 22-2 for other uses.

Again, housing 50 has blade switching mechanism 60, motor 54, energy source 56 and control 58.

Motor 54 is operatively connected to blade assembly 50 via a central shaft 55' such that the motor, when energized, drives the blade assembly via the shaft 55'. Motor 54 is also connected to energy source 56, such as a battery or a plug connected to a standard residential outlet, and control 58. Again, the user, by control 58, can selectively connect and disconnect motor 54 and energy source 56 to energize and de-energize, respectively, the motor.

As shown in FIG. 4, blade assembly 20 has cutting or reciprocating blade 30, stationary blade 32, mounting block 34', screws 35, first spring 36-1 and second spring 36-2. Mounting block 34' has topside 92, bottom side 94, mounting post recess 96, a locking member 98'. Locking member 98' has a front side 198 and a backside 199.

Stationary blade 30 and reciprocating blade 32 are mounted to a mounting block 34' by screws 35 and springs 36-1, 36-2 in a conventional manner. More specifically, reciprocating blade 30 and stationary blade 32 each have a series of cutting teeth 31 that are substantially parallel to one another to form wide cutting edge 22-1 and narrow cutting edge 22-2. Springs 36-1, 36-2 bias reciprocating blade 32 towards stationary blade 30 and aid to reciprocate reciprocating blade 32 as described below.

Blade assembly 20 is operatively coupled with blade switch mechanism 60 to rotate the blade assembly. Blade switch mechanism 60 has mounting post 62, a slider block 64', a bracket 66', and a thumb switch 68'.

Slider block 64' has a top side 72, a bottom side 74, a first driven connection 76', a second driven connection 78', opening 80', and spring supports 81', 82', 83'and 84. Opening 80' has a front side 188 and a backside 189.

Spring supports 81', 82', 83'and 84' of slider block 64' correspond to the matching set of spring holes 11, 12, 13 and 14 in reciprocating blade 32. Spring 36-1 has a set of biasing arms 37-1 and 37-2 and a central member 37-3. Similarly, spring 36-2 has a set of biasing arms 38-1 and 38-2 and a central member 38-3.

Bottom side 74 of slider block 64' is inserted over topside 94 of mounting block 34' such that locking member 98 is in opening 80'. Specifically, front side 198 of locking member 98' is adjacent front side 188 of opening 80' and rear side 199 of the locking member is adjacent rear side 189 of the opening. In this position, shaft 55' of motor 54 is operatively connected to driven connection 78' of slider block 64' to impart reciprocating motion to the slider block.

Central member 37-3 of first spring 36-1 rests on stationary blade 30. Arms 37-1 and 37-2 rest on topside 72 of slider block 64'. Thus, first arm 37-1 is connected to spring support 81' of slider block 64' and spring hole 11 of reciprocating blade 30 and second arm 37-2 is connected to spring support 82' of the slider block and spring hole 12 of the reciprocating blade. Second spring 36-2 is similarly situated. Namely, central member 38-3 of second spring 36-2 rests on stationary blade 30. Arms 38-1 and 38-2 rest on topside 72 of slider block 64'. Thus, first arm 38-1 is connected to spring support 84' of slider block 64' and spring hole 14 of reciprocating blade 30 and second arm 37-2 is connected to spring support 83' of the slider block and spring hole 13 of the reciprocating blade. In this manner, reciprocation of slider block 64' back and forth is transmitted via springs 36-1, 36-2 to reciprocating blade 30 as the reciprocating blade is biased towards stationary blade 32.

It should be noted that slider block 64' and mounting block 34' are not secured to one another. Springs 36-1, 36-2 merely compress bottom 74 of slider block 64' onto top 94 of mounting block 34'. By overcoming the compressive forces of springs 36-1, 36-2, mounting block 34' is slidable downward such that locking member 98' is no longer within opening 80'. It should also be noted that shaft 55' of motor is not secured to second driven connection 78 of slider block 64'. Rather, shaft 55' and second driven connection 78 are only connected to enable motor 54 to impart reciprocating motion to slider block 64'. Sliding mounting block 34' downward with respect to slider block 64' causes shaft 55' to be removed from second driven connection 78.

Mounting post 62 has a biasing end 101 and a control end 103. Biasing end 101 is inserted through opening 80' of slider block 64' into mounting post recess 96 of mounting block 34'. Post 62 extends upward from blade assembly 20 into housing 50. Bracket 66' is secured in position in housing 50 such that post 62 is slidably received in a bore 67 defined therein. Post 62 is of sufficient length such that control end 103 extends out of housing 50.

Thumb switch 68' is connected to control end 103 of mounting post 62, preferably via a cam 115' and a rod 116'. Thumb switch 68' is depressably and rototably mounted in housing 50. Depressing switch 68' downward in the direction of arrow B causes the thumb switch to exert a depression force in the direction of arrow B onto mounting post 62 in direction parallel to axis A. Thumb switch 68' is biased in its normal position in which the thumb switch is not exerting force B onto mounting post 62. Preferably, thumb switch 68' is biased in its normal position by a spring disposed between bracket 66' and housing 50. Spring 112 exerts a return force, opposite to force B, to thumb switch 68' to extend the thumb switch away from the housing 50.

Depression force in direction of arrow B being sufficient to overcome the return force of spring 112 and the compressive forces of springs 36-1, 36-2, causes post 62 to slide downward in bracket 66' and slider block 64' such that biasing end 101 of the post urges mounting block 34' downward. Mounting block 34' slides downward such that locking member 98 is no longer in opening 80' and shaft 55' is no longer operatively connected to second driven connection 78. At this point, application of a rotational force C to thumb switch 68 causes blade assembly 20 to rotate about axis A with respect to housing 50. More specifically, mounting block 34' rotates with respect to slider block 64' until shaft 55' is adapted to be operatively connected to first driven connection 76 and locking member 98' is adapted to be re-inserted in opening 80 such that front side 198 of the locking member is adjacent to rear side 189 of the opening and rear side 199 of the locking member is adjacent to front side 188 of the opening.

Removal of force B from thumb switch 68' causes spring 112 to exert thumb switch return force to extend the thumb switch away from the front of housing 50 and causes springs 36-1, 36-2 to bias mounting block 34' up towards slider block 64'. Thus, post 62 slides upwards through bracket 66' and slider block 64' until shaft 55' is operatively connected to first driven connection 76 and locking member 98' is re-inserted in opening 80 such that front side 198 of the locking member is adjacent to rear side 189 of the opening and rear side 199 of the locking member is adjacent to front side 188 of the opening.

Thus, switch mechanism 60 allows the user to rotate blade assembly 20 to present either wide cutting edge 22-1 or narrow cutting edge 22-2 to the user.

In alternate embodiments of clipper 10 (not shown), the clipper is adapted to receive a plurality of trimming combs for adjusting the length of the hair to be trimmer. For example, blade assembly 20 is adapted to removably receive a trimming comb. Other examples include attaching the trimming comb to housing 50 and/or a combination of blade assembly 20 and the housing. Single sided trimming combs, namely those adapted to fit only one of the cutting edges 22 of clipper 10 are considered within the scope of the present invention. Alternately, double sided trimming combs, namely those adapted to fit all cutting edges 22 of clipper 10 are considered within the scope of the present invention.

It should be understood that the foregoing description is only illustrative of the present invention. Various alternatives and modifications can be devised by those skilled in the art without departing from the invention. Accordingly, the present invention is intended to embrace all such alternatives, modifications and variances.

What is claimed is:

1. A hair clipper comprising:

a housing;

a rotating blade assembly removably connected to said housing, said blade assembly having two or more diametrically opposed cutting edges and having a single cutting plane, said blade assembly being adapted to selectively rotate about an axis substantially normal to said cutting plane; and a switch mechanism being operatively connected to said blade assembly for selectively unlocking said blade assembly thereby enabling said blade assembly to be rotated about said axis.

2. The hair clipper of claim 1, further comprising a motor and a control, said control selectively connecting said motor to an energy source.

3. The hair clipper of claim 2, wherein said energy source is a battery.

4. The hair clipper of claim 2, wherein said energy source is an electrical outlet.

5. The hair clipper of claim 1, wherein said two or more cutting edges includes a wide cutting edge.

6. The hair clipper of claim 1, wherein said two or more cutting edges include a narrow cutting edge.

7. The hair clipper of claim 1, wherein said two or more cutting edges have two or more blades.

8. The hair clipper of claim 7, wherein said two or more blades include a stationary blade.

9. The hair clipper of claim 8, wherein said two or more blades include a reciprocating blade.

10. The hair clipper of claim 9, wherein said reciprocating blade and said stationary blade are positioned adjacent each other and spring biased toward each other.

11. The hair clipper of claim 1, wherein said switch mechanism includes a button that is rockably mounted in said housing.

12. The hair clipper of claim 1, wherein said switch mechanism includes a thumb switch, said thumb switch being depressably and rotably mounted in said housing.

13. A method for cutting hair using a hair clipper having a rotating blade assembly, the method comprising:

a) providing a hair clipper having a housing with a control for selectively connecting a motor positioned in said housing to an energy source, a rotating blade assembly removably connected to said housing, said blade assembly having two or more diametrically opposed cutting edges and having a single cutting plane, said blade assembly being adapted to selectively rotate about an axis substantially normal to said cutting plane, and a switch mechanism with a rocking button operatively connected to said blade assembly and a locking member for selectively unlocking said blade assembly thereby enabling said blade assembly to rotate about said axis, b) applying a force to said rocking button such that said rocking button is caused to rock toward said housing thereby unlocking said locking member to allow said blade assembly to freely rotate about said axis, c) applying a rotational force to said blade assembly such that said blade assembly is caused to rotate about said axis until a desired position is reached, d) removing said rotational force from said blade assembly once said blade assembly is in said desired position, e) removing said force from said rocking button such that said rocking button is biased away from said blade assembly thereby locking said locking member to prevent said blade assembly from rotating about said axis, f) actuating said control to energize said motor of said hair clipper.

14. The method of claim 13, wherein said energy source is a battery.

15. The method of claim 13, wherein said energy source is an electrical outlet.

16. The method of claim 13, wherein said blade assembly has two or more cutting edges.

17. The method of claim 16, wherein said two or more cutting edges include a wide cutting edge.

18. The method of claim 17, wherein said two or more cutting edges include a narrow cutting edge.

19. The method of claim 18, wherein said two or more cutting edges have two or more blades.

20. The method of claim 19, wherein said two or more blades include a stationary blade.

21. The method of claim 20, wherein said two or more blades include a reciprocating blade.

22. The method of claim 21, wherein said reciprocating blade and said stationary blade are positioned adjacent each other and spring biased toward each other.

23. A method for cutting hair using a hair clipper having a rotating blade assembly, the method comprising:

a) providing a hair clipper having a housing with a control for selectively connecting a motor positioned in said housing to an energy source, a rotating blade assembly removably connected to said housing, said blade assembly having two or more cutting edges and having a single cutting plane, said blade assembly being adapted to selectively rotate about an axis substantially normal to said cutting plane, and a switch mechanism with a thumb switch operatively connected to said blade assembly and a locking member for selectively unlocking said blade assembly thereby enabling said blade assembly to rotate about said axis, b) applying a downward force to said thumb switch such that said thumb switch is caused to move toward said housing thereby unlocking said locking member to allow said blade assembly to freely rotate freely said axis, c) applying a rotational force to said thumb switch such that said blade assembly is caused to rotate about said axis until a desired position is reached, d) removing said rotational force from said thumb switch once said blade assembly is in said desired position, e) removing said force from said thumb switch such that said thumb switch is biased away from said blade assembly thereby locking said locking member to prevent said blade assembly from rotating about said axis, e) removing said downward force from said rocking button allowing said thumb switch to move away from said housing thereby locking said locking member to prevent said blade assembly from rotating about said axis, f) actuating said control to energize said motor of said hair clipper.

24. The method of claim 23, wherein said energy source is a battery.

25. The method of claim 23, wherein said energy source is an electrical outlet.

26. The method of claim 23, wherein said blade assembly has two or more cutting edges.

27. The method of claim 26, wherein said two or more cutting edges include a wide cutting edge.

28. The method of claim 27, wherein said two or more cutting edges include a narrow cutting edge.

29. The method of claim 28, wherein said two or more cutting edges have two or more blades.

30. The method of claim 29, wherein said two or more blades include a stationary blade.

31. The method of claim 30, wherein said two or more blades include a reciprocating blade.

32. The method of claim 31, wherein said reciprocating blade and said stationary blade are positioned adjacent each other and spring biased toward each other.

* * * * *